US005775531A

United States Patent [19]

Lowry

[11] Patent Number: 5,775,531

[45] Date of Patent: Jul. 7, 1998

[54] CONTAINER FOR POWDERED PRODUCT HAVING A MEASURING CUP DEVICE THEREIN

[75] Inventor: James W. Lowry, Florence, S.C.

[73] Assignee: Sonoco Products Company, Hartsville, S.C.

[21] Appl. No.: 780,855

[22] Filed: Jan. 9, 1997

[51] Int. Cl.[6] ..... B65D 1/24

[52] U.S. Cl. ..... 220/212.5; 220/212; 220/574.1; 220/735

[58] Field of Search ..... 220/212, 212.5, 220/735, 574.1, 736

[56] References Cited

U.S. PATENT DOCUMENTS

| | | | |
|---|---|---|---|
| 1,834,085 | 12/1931 | Bloom | 220/735 |
| 3,679,093 | 7/1972 | Chang | 220/735 |
| 4,036,392 | 7/1977 | Martin | 220/735 |
| 4,216,875 | 8/1980 | Stanish | 220/212 |
| 5,586,676 | 12/1996 | Lynd | 220/212 |

FOREIGN PATENT DOCUMENTS

| | | | |
|---|---|---|---|
| 2142322 | 1/1985 | United Kingdom | 220/212 |

*Primary Examiner*—Joseph M. Moy
*Attorney, Agent, or Firm*—Bell Seltzer Intellectual Property Law Group of Alston & Bird LLP

[57] ABSTRACT

A container for being filled with a powdered product includes a container body having an open bottom end and an end closure attached to the container top end portion for closing the container top end portion to adapt the container to be filled through the open bottom end portion with the container in an inverted position. The top end closure includes an easy-opening feature for adapting the container to be easily opened by removing at least a part of the top end closure to obtain access to the powdered product within the container after filling and closure of the bottom end portion. A measuring cup device is detachably attached at its closed side to an inside surface of the part of the top end closure adapted to be removed during container opening (1) for adapting the cup device to be removed and detached for use after opening of the container and (2) for adapting the container to be filled in the inverted position with an open side of the cup device facing up to receive powdered product therein during filling to prevent undesirable air from being trapped within the cup device.

7 Claims, 3 Drawing Sheets

CONTAINER FOR POWDERED PRODUCT HAVING A MEASURING CUP DEVICE THEREIN

FIELD OF THE INVENTION

This invention is directed to a container adapted to be filled with a powdered product and having a measuring or dispensing cup therein.

BACKGROUND OF THE INVENTION

In some containers adapted for packaging powdered products, such as food products, cleaning products, etc., it is often desirable to place a measuring or dispensing cup device, such as a scoop, in the container for removal and use by the consumer after the container has been opened for measuring and dispensing the powdered product. If the scoop is simply placed in the container with the powdered product either before or during filling of the container with the product, the consumer will have to dig through the product to find the scoop after the container is opened which is cumbersome and increases the chances of contamination of the product by the hands of the consumer.

It has been suggested to attach the measuring cup to a portion of a top end closure of the container so that when the top end closure of the container is removed for opening of the container, the measuring cup will be readily available to the consumer. However, air can be trapped under the measuring cup during or after filling of the container which causes problems with the powdered product, particularly if the product is susceptible to contamination by oxygen. To avoid this problem, and to place the measuring cup next to the top closure so that it will be readily available to the consumer upon opening of the container, most current commercial operations involve an insertion of the measuring cup into the top of a filled container and pushing it down into the top of the powdered product so as to avoid air entrapment and to have it readily available at the top of the container upon opening of the container. This operation, however, is slow and cumbersome and renders the entire manufacturing operation more expensive.

OBJECT AND SUMMARY OF THE INVENTION

Accordingly, it is an object of this invention to overcome the above problems and to provide a container for being filled with a powdered product and which has a measuring cup device therein which prevents trapping of undesirable air within the measuring cup device during filling of the container and which positions said measuring cup device for easy access by the consumer upon opening of the container through the top end closure.

It has been found by this invention that the above object may be accomplished by providing a container having the following construction.

A hollow container body is provided of desired configuration which defines top and bottom opposite end portions. The container bottom end portion is open for filling of the container with powdered product through the bottom end and with the container in an inverted position and is adapted to be closed after filling. An end closure is attached to the container top end portion for closing the top end portion to adapt the container to be filled through the open bottom end portion while the container is in the inverted position. The top end closure includes an easy opening means for adapting the container to be easily opened by removing at least a part of the top end closure to obtain access to the powdered product within the container after filling and closure of the bottom end portion. A measuring cup device is provided which has an open side and a closed side. The measuring cup device is detachably attached at its closed side to an inside surface of the part of the top end closure which is adapted to be removed during container opening.

This construction adapts the measuring cup device to be removed and detached for use after opening of the filled container by removing the part of the top end closure to which it is attached. This construction also adapts the container to be filled in the inverted position with the open side of the measuring cup device facing up so that the powdered product will fill the cup device during filling to prevent undesirable air from being trapped within the measuring cup device during the filling operation.

BRIEF DESCRIPTION OF THE DRAWING

Some of the objects and advantages of this invention have been set forth above, other objects and advantages will appear in the following detailed description of preferred embodiments of the invention, when taken in conjunction with the accompanying drawings, in which.

DETAILED DESCRIPTION OF THE PREFERRED EMBODIMENTS OF THE INVENTION

Figure 1:
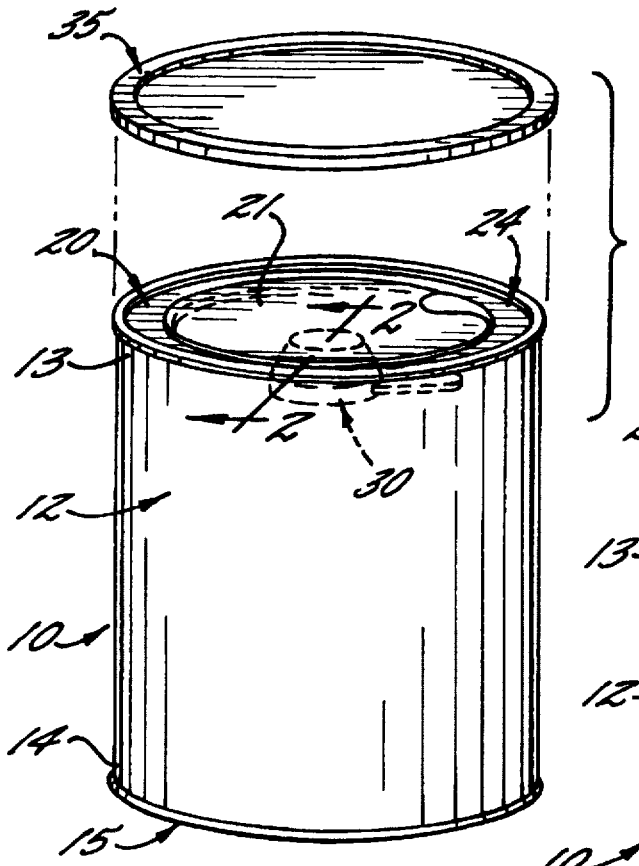
FIG. 1 is a perspective view, partially exploded, of a filled container constructed in accordance with this invention with a measuring cup device therein and having a first embodiment of a top end closure.

Referring now to the drawings, there is shown therein a container, generally indicated at 10, which is adapted for being filled with a powdered product P, such as food products, cleaning products, etc. The container 10 may be of any desired configuration and may be constructed of any desired material including composites, plastic, metal, etc. However, it is preferred that the container 10 be of a generally cylindrical configuration and be constructed of composite material of the type normally utilized for constructing containers for powdered products P of the type contained by the container 10 of this invention and well understood by those with ordinary skill in the art.

Figure 4A:
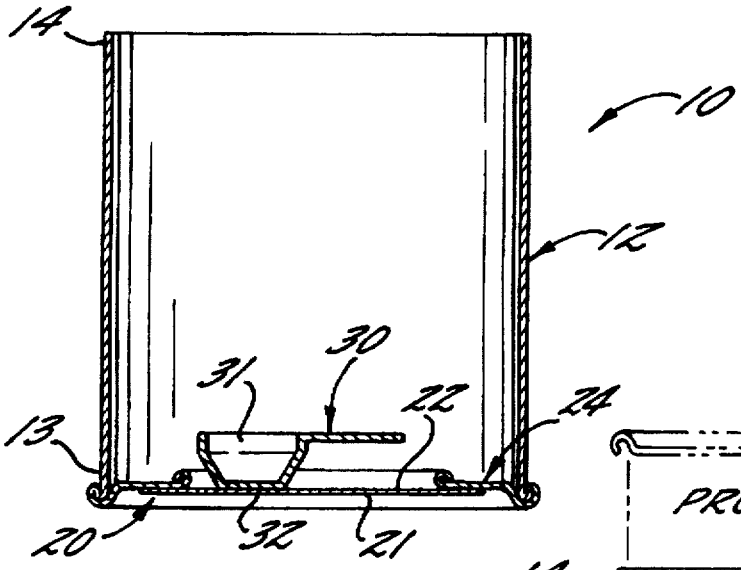
FIG. 4A is a sectional elevational view of the container of FIG. 1 in an inverted position and with the bottom end portion open prior to filling of the container with the powdered product.
Figure 4B:
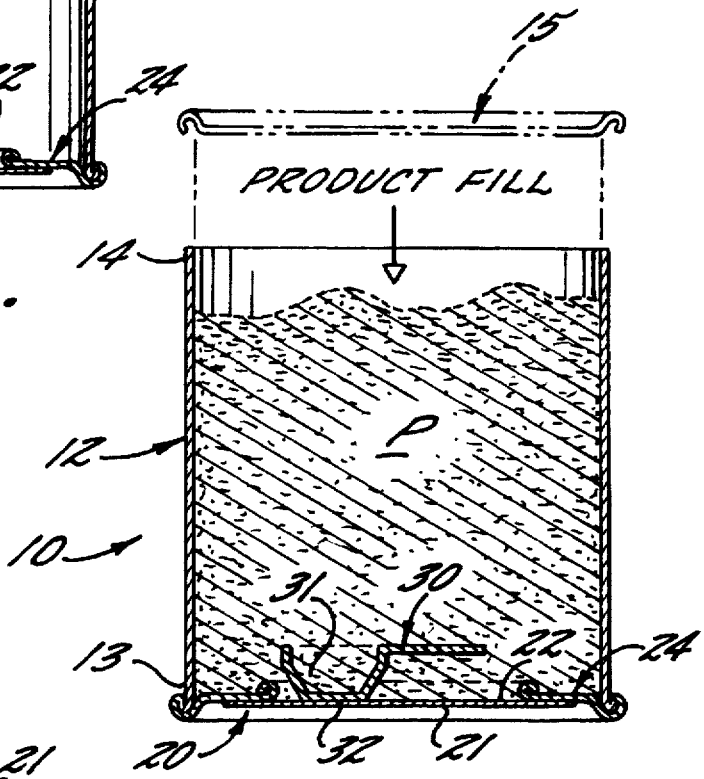
FIG. 4B is a view, like FIG. 4A, illustrating the container after filling thereof with a powdered product and illustrating a bottom closure in position for being attached to the container for closing of the container.

The container 10 comprises a hollow container body 12 defining top and bottom opposite end portions 13, 14. The container bottom end portion 14 is open for filling of the container 10 with the powdered product P through the open bottom end 14 and with the container 10 in an inverted position (as shown in FIGS. 4A and 4B). This container bottom end portion 14 is adapted for being closed after filling by a suitable bottom end closure 1 5 which is seamed thereto and which may be constructed of metal, composite, plastic or any suitable material.

Figure 3:
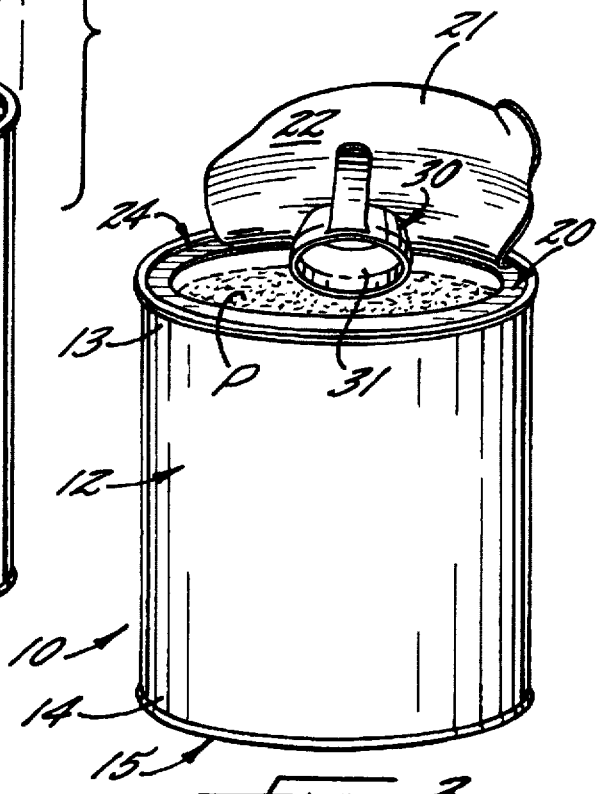
FIG. 3 is a perspective view of the filled container of FIG. 1 illustrating such container being opened.

An end closure 20 is attached to the container top end portion 13 by seaming for closing the top end portion 13 to adapt the container 10 to be filled through the open bottom end portion 14 while the container 10 is in the inverted position (as shown in FIGS. 4A and 4B). The top end closure 20 includes easy-opening means (to be defined more specifically below) for adapting the container 10 to be easily opened by removing at least a part 21 of the top end closure 20 to obtain access to the powdered product P within the container 10 after filling and closure of the bottom end portion 14 (as may be seen particularly in FIG. 3).

Figure 4C:
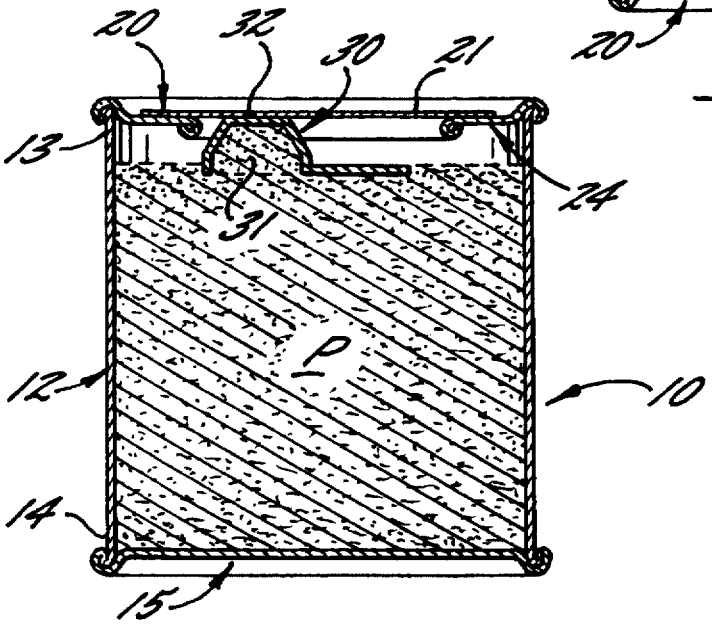
FIG. 4C is a view, like FIGS. 4A and 4B, illustrating a filled container after a bottom closure has been attached and the container has been inverted to have the top end portion in the upward position.

A measuring cup device 30, which may be preferably in the form of a scoop, has an open side 31 and a closed side 32. The measuring cup device 30 is detachably attached, by suitable adhesive or other means, at the closed side 32 to an inside surface 22 of the part 21 of the top end closure 20 which is adapted to be removed during container opening. This arrangement adapts the container 10 to be filled in the inverted position (illustrated in FIGS. 4A and 4B) with the open side 31 of the cup device 30 facing up to receive powdered product P therein during filling (as shown in FIG. 4B) to prevent undesirable air from being trapped within the cup device 30 during the filling operation and after inverting the container 10 to the upright position (as shown in FIG. 4C). During the filling operation, undesirable air may be evacuated from the container and/or desirable air, such as nitrogen, may be inserted into the container. This described arrangement prevents undesirable air from being trapped within the cup device 30 by the powdered product P which prevents evacuation thereof during completion of the filling operation. This arrangement also adapts the cup device 30 to be removed with the part 21 of the top end closure which is removed during container opening so that the cup device 30 may then be detached from this part 21 for use in measuring or dispensing the powdered product P. The measuring cup device 30 may be constructed of any suitable material, such as plastic, metal, etc.

The container 10 may further include an overcap 35 constructed of any suitable material, preferably plastic, for fitting over the top end closure 20 before and after opening of the container 10 in the manner discussed above for purposes well understood by those with ordinary skill in the art.

Figure 2:
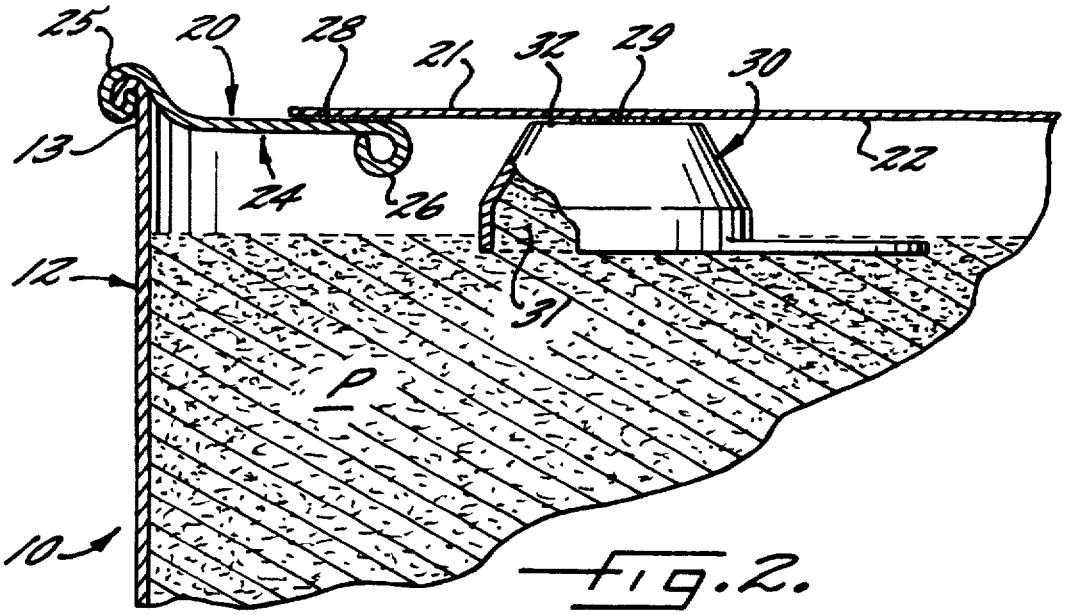
FIG. 2 is an enlarged partial sectional view, partly broken away, of the container of FIG. 1 and taken generally along the line 2—2 of FIG. 1.

The container 10 illustrated in FIGS. 1–4 includes a first embodiment of a top end closure 20 and easy-opening means included therein. This first embodiment of a top end closure 20 includes a metal end ring 24 of any suitable metal material including aluminum and steel and which may be either coated or laminated with a heat-sealable material. The heat-sealable material is preferably in the form of a polymer dispersion in a "can coating" (well known to those with ordinary skill in the art) that is applied in a standard can coating process or formed as a lamination of a polymer film to the metal. This metal end ring 20 has a deformable outside peripheral area 25 which is seamed to the container top end portion 13 in a manner well understood by those with ordinary skill in the art. The metal end ring 24 further includes an inside peripheral area 26 which defines an inside central opening therein to allow access therethrough to the interior of the container 10. This inside peripheral area 26 may be downwardly and inwardly curled (as shown in FIG. 2) to prevent cutting or other damage to the hand of a user when reaching inside of an open container 10.

This first embodiment of end closure 20 of FIGS. 1–4 further includes a membrane patch of sufficient size to cover the central opening in the metal end ring 24 and which defines the part 21 of the top end closure 20 which is removed during container opening. The membrane patch or removable part 21 is attached to an outside surface of the metal end ring 24 by a bond 28 having a predetermined strength to maintain closure of the container top end portion 20 while allowing easy-opening of the end closure 20 by detachment and removal of the membrane patch or removable part 21 from the metal end ring 24. This membrane patch 21 may be constructed of any suitable material and the bond 28 may be any suitable bond. It has been found desirable to construct the membrane patch 21 to include a polypropylene heat seal layer at least on the bottom thereof and a foil backbone layer may be included along with any additional desired layer on top of the foil layer to add additional strength to the membrane patch 21. This top layer may be a polyester laminate. The polypropylene heat seal layer may be cast polypropylene, blown polypropylene or may be in the form of a co-extrusion. With the use of a polypropylene bottom layer on the membrane patch 21 and a polypropylene upper layer on the metal end ring 24, the bond 28 between the membrane patch 21 and the metal end ring 24 may be a heat seal bond which provides sufficient strength in the shear direction to resist internal forces within the container 10, while being sufficient weak in the tensile direction to allow peeling of the bond 28 for easy-opening of the top end closure 20 of the container 10.

The measuring cup device 30 is detachably attached at its closed side 32 to the inside surface of the membrane patch 21 by a bond 29 (see FIG. 2) which may also be a suitable heat seal bond between the measuring cup device 30 and the polypropylene inside layer of the membrane patch 21. This heat seal bond also allows peeling thereof in the tensile direction for detachment of the measuring cup device 30 from the membrane patch 21 after opening of the top end closure of the container 10.

Figure 5:
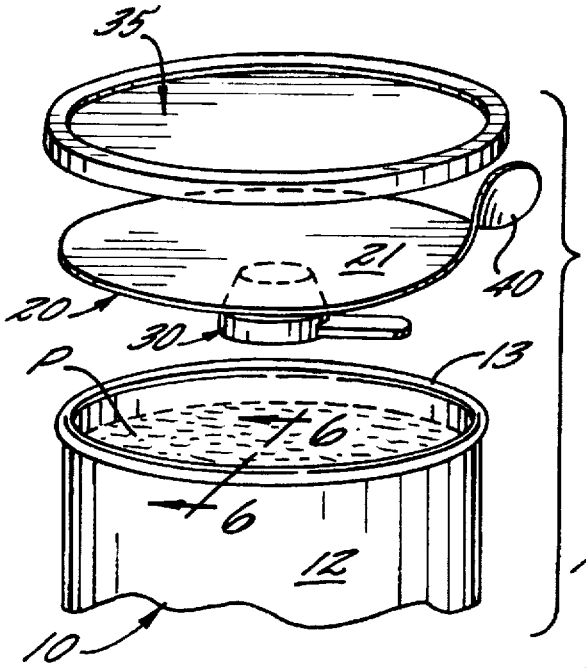
FIG. 5 is a view of the top portion of a filled container constructed in accordance with this invention and having a second embodiment of a top end closure and illustrating such top end closure after opening thereof to obtain access to the interior of the container.
Figure 6:
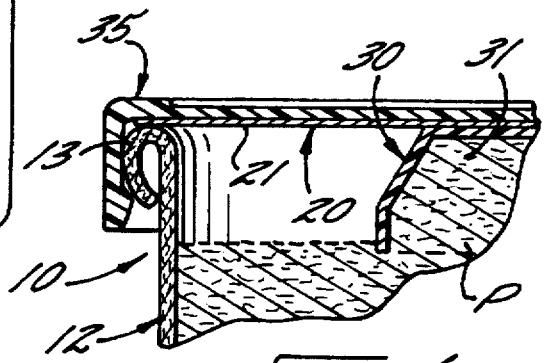
FIG. 6 is an enlarged partial sectional view of the container of FIG. 5 in a non-opened condition and taken generally along the line 6—6 of FIG. 5.

Referring now to FIGS. 5 and 6, there is shown therein the container 10 of this invention with a second embodiment of a top end closure 20 with easy-opening means therein. In this embodiment of top end closure 20, the upper end portion 13 of the container body 12 is outwardly curled to provide an upper flat surface. The top end closure 20 and easy-opening means of this embodiment includes a membrane member of predetermined dimensions to cover the container top end portion 13 and comprises the part 21 of the top end cover to be removed during opening of the container 10. This membrane member or removable part 21 may be constructed of the same materials discussed above with respect to the membrane patch 21 of the first embodiment of top closure of FIGS. 1–4 and is attached to the container top end portion 13 by a bond having predetermined strength to maintain closure of the container top end portion 13 while allowing easy-opening of the end closure 20 by detachment and removal of the membrane member 21 from the container top end portion 13. This bond between the membrane member 21 and the container top end portion 13 may also be a heat sealed bond formed by the polypropylene layer on the bottom of the membrane member 21 and a further layer of 5 which may be present on the top surface of the curled container top end portion 13. To aid in peeling of the membrane member 21 from the container top end portion 13, a pull tab 40 may be incorporated in the membrane member 21. The shear and tensile strengths of this bond may be as discussed above in accordance with the first embodiment of top end 10 closure 20 of FIGS. 1–4. In this embodiment of a top end closure 20, the measuring cup device is detachably attached to the inside surface of the membrane member 21 in the same manner discussed above with respect to the first embodiment of top end closure 20 of FIGS. 1–4.

Figure 7:
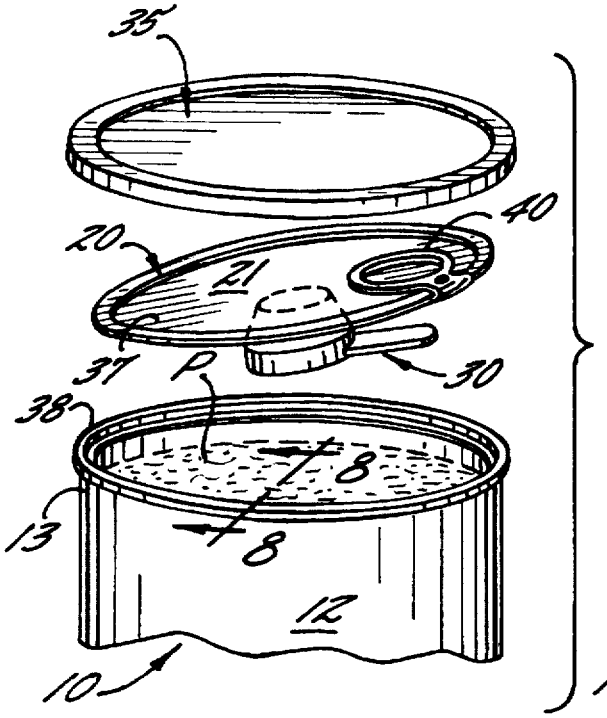
FIG. 7 is a view of the top portion of a filled container constructed in accordance with this invention and having a third embodiment of a top end closure and illustrating such top end closure after opening thereof to obtain access to the interior of the container.
Figure 8:
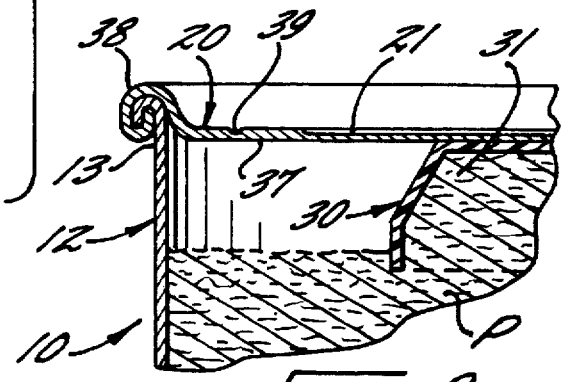
FIG. 8 is an enlarged partial sectional view of the container of FIG. 5 in a non-exploded condition with the overcap removed and taken generally along the line 8—8 of FIG. 7.

Referring now to FIGS. 7 and 8 of the drawings, there is shown a third embodiment of top end closure 20 and easy-opening means for the container 10 of this invention. This embodiment of a top end closure 20 and easy-opening means therein includes a metal end member 37 of predetermined dimensions to cover the container top end portion 13 and which has a deformable outside peripheral area 38 seamed to the container top end portion 13 (as shown in FIG. 8). This metal end member 37 may be constructed of any suitable metal material including steel, aluminum or the like. The metal end member 37 includes a score line of weakness 39 which surrounds the removable part 21 of the metal end ring 37 to be removed during opening of the top end closure 20. This score line of weakness 39 has a predetermined strength to maintain closure of the container top end portion 13 while allowing easy-opening of the end closure 20 by detachment and removal of the part 21 of the metal end ring 37 along the score line of weakness 39. For this purpose, a pull tab 40 may be incorporated on the metal end member 37. In this embodiment, the measuring cup device 30 is detachably attached in any suitable manner, including a heat seal as described above, to the inside surface of the removable part 20 of the metal end member 37.

Accordingly, there has been described herein a construction of a container 10 for being filled with a product P which includes several embodiments of an end closure 20 which adapts the container 10 to be filled through the open bottom end portion 14 while the container 10 is in the inverted position.

All of the above described embodiments of top end closures 20 include easy-opening means adapt the container 10 to be easily opened by removing at least a part 21 of the top end closure 20 to obtain access to the powdered product P within the container 10 after filling and closure of the bottom end portion 14. A measuring cup device 30, preferably in the form of a scoop, is detachably attached at the closed side 32 to an inside surface of the part 21 of the top end closure 20 adapted to be removed during container opening (1) for adapting the cup device 30 to be removed and detached for use after opening of the container 10 and (2) for adapting the container 10 to be filled in the inverted position with the open side 31 of the cup device 30 facing up to receive powdered product P therein during filling to prevent undesirable air from being trapped within the cup device 30.

In the drawings and specification, there has been set forth preferred embodiments of the invention and, although specific terms are employed, these terms are used in a generic and descriptive sense only and not for purposes of limitation, the scope of the invention is set forth in the following claims.

What is claimed is:

1. A container adapted for being filled with a powdered product and comprising:

a hollow container body of desired configuration defining top and bottom opposite end portions;

said container bottom end portion being open for filling of said container with the powdered product through said open bottom end and with said container in an inverted position and being adapted to be closed after filling;

an end closure attached to said container top end portion for closing said top end portion to adapt said container to be filled through said open bottom end portion while said container is in the inverted position, said top end closure including easy-opening means for adapting said container to be easily opened by removing at least a part of said top end closure to obtain access to the powdered product within said container after filling and closure of said bottom end portion; and a measuring cup device having an open side and a closed side and being detachably attached at said closed side to an inside surface of said part of said top end closure adapted to be removed during container opening (1) for adapting said cup device to be removed and detached for use after opening said container and (2) for adapting said container to be filled in the inverted position with said open side of said cup device facing up to receive powdered product therein during filling to prevent undesirable air from being trapped within said cup device.

2. A container, as set forth in claim 1, in which said end closure and said easy-opening means included therein comprise a metal end ring having a deformable outside peripheral area seamed to said container top end portion and defining an inside central opening to allow access therethrough to the interior of said container, and a membrane patch of sufficient size to cover said central opening and being attached to an outside surface of said metal end ring by a bond having a predetermined strength to maintain closure of said container top end portion while allowing easy-opening of said end closure by detachment and removal of said membrane patch from said metal end ring; and in which said measuring cup device is detachably attached to said membrane patch.

3. A container, as set forth in claim 1, in which said end closure and said easy-opening means included therein comprise a membrane member of predetermined dimensions to cover said container top end portion and being attached to said container top end portion by a bond having predetermined strength to maintain closure of said container top end portion while allowing easy-opening of said end closure by detachment and removal of said membrane member from said container top end portion; and in which said measuring cup device is detachably attached to said membrane member.

4. A container, as set forth in claim 1, in which said end closure and said easy-opening means included therein comprise a metal end member of predetermined dimensions to cover said container top end portion and having a deformable outside peripheral area seamed to said container top end portion and including a score line of weakness surrounding a part of said metal end member to be removed and having a predetermined strength to maintain closure of said container top end portion while allowing easy-opening of said end closure by detachment and removal of said part of said metal end member within said score line of weakness; and in which said measuring cup device is detachably attached to said part of said metal end member within said score line of weakness.

5. A container, as set forth in claim 1, 2, 3 or 4, in which said container body comprises a generally cylindrical configuration and is constructed of composite material.

6. A container, as set forth in claim 1, 2, 3 or 4, in which said measuring cup device comprises a scoop.

7. A container, as set forth in claim 1, 2, 3 or 4, in which said container body comprises a generally cylindrical configuration and is constructed of composite material; and in which said measuring cup device comprises a scoop.

* * * * *

UNITED STATES PATENT AND TRADEMARK OFFICE

CERTIFICATE OF CORRECTION

PATENT NO. : 5,775,531

DATED : July 7, 1998

INVENTOR(S) : James W. Lowry

It is certified that error appears in the above-identified patent and that said Letters Patent is hereby corrected as shown below:

ON THE TITLE PAGE:

Column 1, References Cited - U.S. Patent Documents, all the following U.S. Patents:

| | | |
|---|---|---|
| 766,592 | 8-2-04 | Cheney |
| 1,476,411 | 12-4-23 | Nahm |
| 1,659,155 | 2-14-28 | Peterson |
| 2,738,900 | 3-20-56 | Wenger |
| 2,921,707 | 1-19-60 | Sloan |
| 2,942,752 | 6-28-60 | Brunel |
| 3,334,778 | 8-8-67 | Saunders |
| 3,380,307 | 4-30-68 | Frank |
| 3,487,974 | 1-6-70 | Schovee |
| 3,550,805 | 12-29-70 | Leonforte |
| 3,722,779 | 3-27-73 | Chang |
| 4,036,398 | 7-19-77 | Hoogvelt et al |
| 4,432,466 | 2-21-84 | Allen |
| 4,930,637 | 6-5-90 | DeRoseau |
| 5,090,572 | 2-25-92 | DeRoseau |
| 5,251,774 | 10-12-93 | Engle |
| 5,415,309 | 5-16-95 | Wang |
| 5,443,174 | 8-22-95 | Bauer |

Signed and Sealed this

Eighth Day of September, 1998

*Attest:*

Bruce Lehman

BRUCE LEHMAN

*Attesting Officer*

*Commissioner of Patents and Trademarks*